US009175930B1

(12) United States Patent
Pezeshkian et al.

(10) Patent No.: US 9,175,930 B1
(45) Date of Patent: Nov. 3, 2015

(54) ADAPTIVE ELECTRONIC CAMOUFLAGE

(75) Inventors: Narek Pezeshkian, Glendale, CA (US); Hobart R. Everett, San Diego, CA (US); Joseph D. Neff, San Diego, CA (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 508 days.

(21) Appl. No.: 13/434,174

(22) Filed: Mar. 29, 2012

(51) Int. Cl.
*F41H 3/00* (2006.01)

(52) U.S. Cl.
CPC ..... *F41H 3/00* (2013.01)

(58) Field of Classification Search
CPC ..... F41H 3/00; F41H 3/02; G09G 2380/02; H04N 21/482; H04N 21/812; H04N 21/251; H04N 21/25808; H04N 21/25816; H04N 21/25891; H04N 21/2665; H04N 21/4104; H04N 21/422; H04N 21/42204; H04N 21/42225; H04N 21/435; H04N 21/438; H04N 21/44218
USPC ..... 348/148
See application file for complete search history.

(56) References Cited

U.S. PATENT DOCUMENTS

| | | | | |
|---|---|---|---|---|
| 5,144,877 | A | 9/1992 | Parks | |
| 5,307,162 | A * | 4/1994 | Schowengerdt | 348/122 |
| 5,549,938 | A | 8/1996 | Nesbitt | |
| 6,333,726 | B1 * | 12/2001 | Bettinger | 345/87 |
| 7,775,919 | B2 | 8/2010 | Oswald | |
| 2002/0117605 | A1 * | 8/2002 | Alden | 250/208.1 |
| 2002/0122113 | A1 * | 9/2002 | Foote | 348/48 |
| 2002/0196340 | A1 * | 12/2002 | Kato et al. | 348/148 |
| 2003/0087580 | A1 | 5/2003 | Shibahashi | |
| 2004/0213982 | A1 * | 10/2004 | Touzov | 428/304.4 |
| 2006/0143798 | A1 | 7/2006 | Chen | |
| 2007/0190368 | A1 * | 8/2007 | Jung et al. | 428/919 |
| 2008/0189215 | A1 * | 8/2008 | Travez et al. | 705/80 |
| 2009/0154777 | A1 * | 6/2009 | Cincotti et al. | 382/111 |
| 2010/0182518 | A1 * | 7/2010 | Kirmse et al. | 348/836 |
| 2010/0288116 | A1 * | 11/2010 | Cincotti et al. | 89/36.02 |
| 2012/0318129 | A1 * | 12/2012 | Jackson et al. | 89/36.02 |

OTHER PUBLICATIONS

Anthony C. Copeland et al, "Texture Synthesis Using Gray-Level Co-Occurrence Models: Algorithms, Experimental Analysis, and Psychophysical Support", Society of Photo-Optical Instrumentation Engineers, Opt. Eng. 40, 2655 (2001); doi:10.1117/1.1412851.

* cited by examiner

*Primary Examiner* — Mohammed Rahaman
(74) *Attorney, Agent, or Firm* — SSC Pacific Patent Office; Arthur K. Samora; Kyle Eppele

(57) ABSTRACT

In one preferred embodiment, the present invention provides an adaptive electronic camouflage platform comprising electronic paper panels conformed to the exterior surface of the vehicle; one or more cameras for sampling images of the local environment surrounding the platform; and a processor for analyzing the sampled images, generating synthesized camouflage patterns corresponding to the sampled images and controlling the display of the synthesized camouflage patterns on the electronic paper panels.

7 Claims, 8 Drawing Sheets
(8 of 8 Drawing Sheet(s) Filed in Color)

FIGURE 11 A
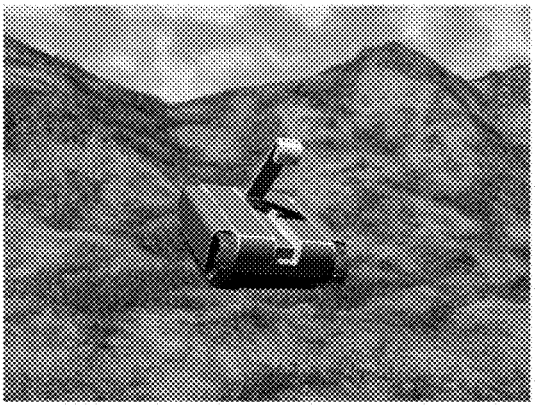
FIGURE 11B
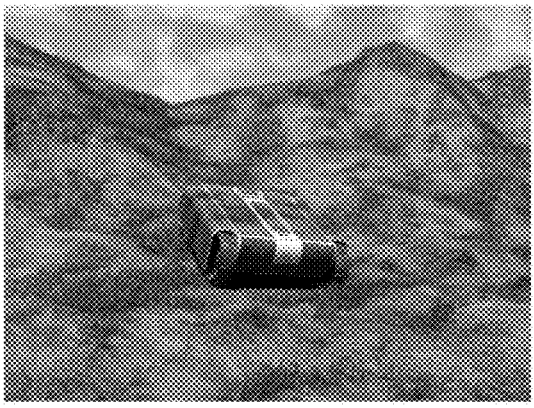
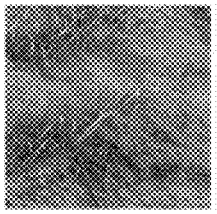
FIGURE 12 A
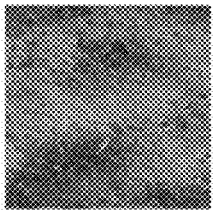
FIGURE 12 B FIGURE 13 A
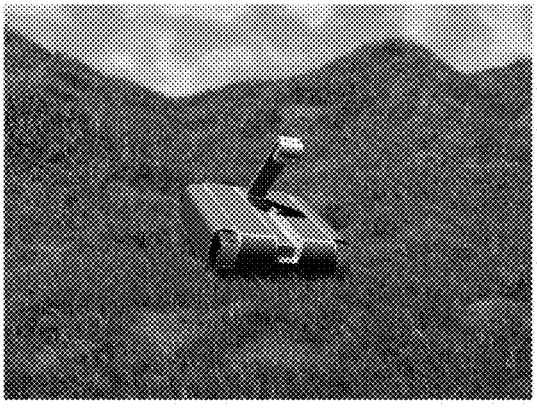
FIGURE 13 B
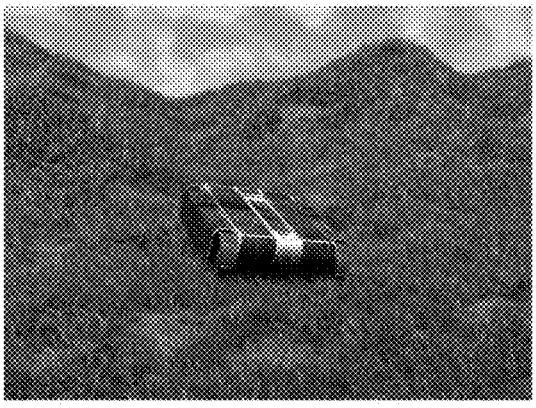
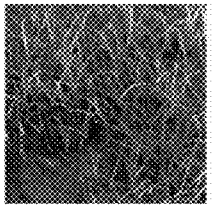
FIGURE 14 A
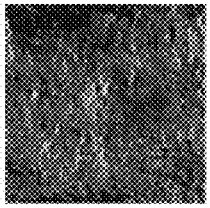
FIGURE 14 B FIGURE 15A
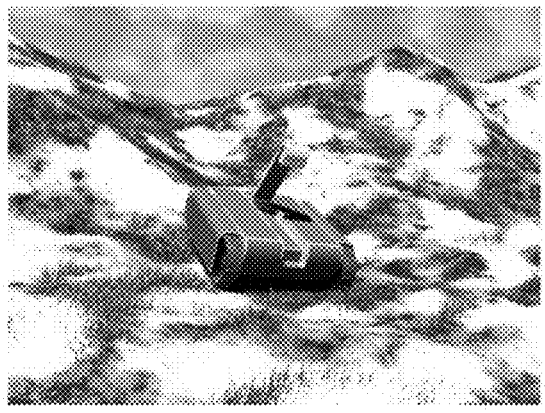
FIGURE 15 B
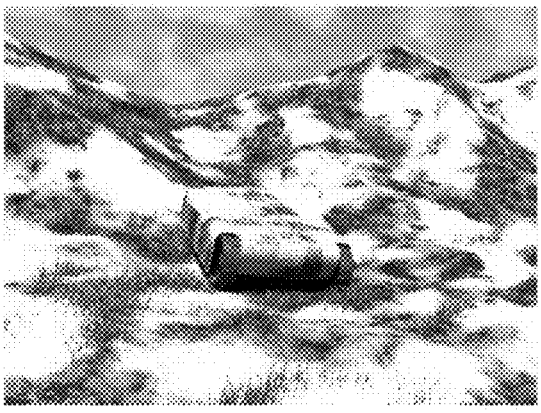
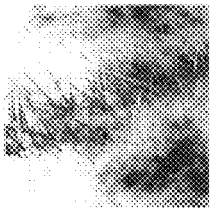
FIGURE 16 A
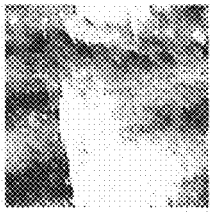
FIGURE 16 B

ADAPTIVE ELECTRONIC CAMOUFLAGE

FEDERALLY-SPONSORED RESEARCH AND DEVELOPMENT

This invention (Navy Case NC 101,118) is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-2778; email T2@spawar.navy.mil.

BACKGROUND OF THE INVENTION

Current methods of camouflaging involve painting a robot or sensor with proper colors and geometric shapes, using camouflaging nets, or a combination of both. The disadvantage is that the painted colors and geometric shapes are fixed and only appropriate in a small number of environments that contain similar colors and shapes. Nets also suffer from the same problem, are cumbersome to apply, and make it difficult or impossible to operate or use the robot or sensor.

SUMMARY OF THE INVENTION

In one preferred embodiment, the present invention provides an adaptive electronic camouflage platform comprising electronic paper panels conformed to the exterior surface of the vehicle; one or more cameras for sampling images of the local environment surrounding the platform; and a processor for analyzing the sampled images, generating synthesized camouflage patterns corresponding to the sampled images and controlling the display of the synthesized camouflage patterns on the electronic paper panels.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The invention will be more fully described in connection with the annexed drawings, where like reference numerals designate like components, in which:

FIGS. 11-16 show examples of the AEC robot in various environments and camouflaged accordingly

DETAILED DESCRIPTION OF THE PREFERRED EMBODIMENTS

Figure 1:
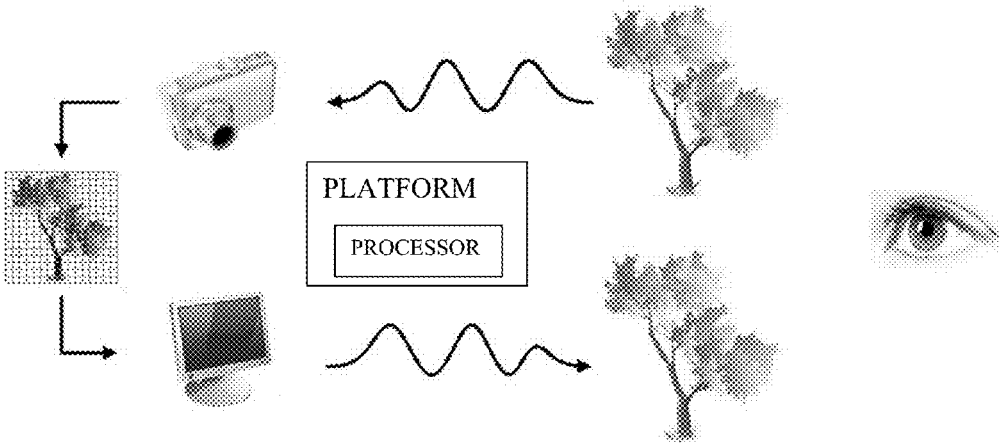
FIG. 1 shows the AEC concept in a simplified manner.

The present invention provides Adaptive Electronic Camouflage (AEC) capability to platforms such as unmanned vehicles (robots) and leave-behind sensors based on the surrounding environment as is done by several species in nature.

In military applications this biologically-inspired camouflaging capability allows a robot or sensor to become more difficult to detect visually by the enemy. This can be achieved by outfitting a robot or sensor with color electronic paper (e-paper), which is a thin, flexible display that consumes zero power when displaying an image and consumes very little power when changing the image.

Companies such as E-Ink, LiquaVista, Mirasol, and many others are currently developing color e-paper for the consumer electronics market. This technology can be leveraged to develop AEC. AEC is achieved by using one or more camera(s) to sample the local environment of the device to be camouflaged, analyzing the image(s), generating an effective camouflage pattern, and displaying the camouflaged pattern on the e-paper that is part of the outer surface or "skin" on the device. The sampling camera(s) may be embedded or external to the device. When a robot or sensor is placed in an environment, it can autonomously determine the most effective camouflage pattern and display it on its skin. If a robot moves from one location to another it can change its camouflage pattern accordingly. With improved display technologies it may be possible to provide a continuous camouflaging capability to a robot on the move.

As described above, one purpose of the invention is to provide Adaptive Electronic Camouflage (AEC) capability to unmanned vehicles (robots) and leave-behind sensors based on the environment as is done by several species in nature. In military applications, this biologically-inspired camouflaging capability will allow a robot or sensor to become more difficult to detect visually by the enemy.

For example, suppose a small throwable robot is tossed and upon coming to rest it takes on the colors and shapes of its local environment. As this robot moves from one location to another it can change its camouflage accordingly at each location. Another example is a leave-behind sensor that is used, say, for surveillance purposes. Once placed at an appropriate location (e.g. placed on the ground, attached to a wall, etc.) its outer surface takes on the colors and shapes of its local environment, making it difficult to detect visually.

A robot or sensor possessing AEC capability will be able to change colors and shapes displayed on its outer surface to match any operational environment. This allows the robot or sensor to be used in a wide-variety of environments with low probability of visual detection. This is a desired capability in Information, Surveillance, and Reconnaissance (ISR) operations where the visual signature of the device must be low.

AEC can be achieved by providing a robot or sensor with the capability to change what is displayed on its outer surface or "skin". This can be achieved by using a thin, flexible display technology such as color electronic paper (e-paper). E-Ink is one company with a commercially available e-paper (monochrome with 16 shades of gray) that is used in the popular Kindle (Amazon) and Nook (Barnes and Nobel) e-readers. Color e-paper is the next logical step and companies such as Mirasol, Liquavista, E-Ink, and many others are working on developing such thin flexible displays. Several major advantages of using such color e-papers are:

Zero power consumption for image display. Power is only consumed when the display changes the image, otherwise the image is maintained even when power is removed.

Flexibility—this will allow a segment of e-paper to be mounted over a round corner. Current technology allows a segment of e-paper to round along a single axis only.

No need for backlight-backlighting must be used with LCD displays and this causes continuous power consumption. Most e-papers are reflective in nature and require ambient light in order to see the image, just like regular paper.

AEC is achieved by sampling the environment with a camera(s), performing image analysis to determine the proper colors and geometric shapes, and displaying the camouflage image on e-paper displays that shroud the outer surface of the item (robot, sensor, etc.) that is to be camouflaged. The overall goal is to have the colors and shapes displayed on the surface roughly match that of the environment as seen by a human eye.

The color matching need not be perfect but it should be sufficient. Sufficiency will have to be determined by subjective testing. However, if today's camouflaging techniques teach us anything, it is that the camouflage pattern's colors and shapes need only roughly match that of the local environment and server to visually breakup edges of the camouflaged object. So long as the camouflage pattern visually breaks up the continuity of a device's outer surface, and the colors roughly match the local environment, then it should be sufficient to fool the eye. This substantially eases the need for good color quality for today's color e-papers, which have a way to go before their color quality becomes as good as LCDs.

FIG. 1 illustrates the AEC concept in a simplified manner. In FIG. 1, a platform such an unmanned vehicle (robot) includes a processor. The top tree in FIG. 1 represents the scene that is sampled by the camera (represented by a point-and-shoot camera icon) onboard the robot or sensor. The digital image is then processed by the processor and displayed on the e-paper display (represented by a monitor icon). The human eye looking at the camouflaged robot or sensor has difficulty visually detecting the robot or sensor since the robot or sensor is displaying the colors and shapes of its local environment.

The camera used to sample the local environment can be the onboard drive/surveillance camera of the robot or sensor, or it can be a dedicated camera used only for camouflaging purposes. Or the camera can be external to the robot or sensor. This external camera could be held by the user, who places the sensor down, takes an image, downloads the image to the device, which then generates the camouflage image and displays it. Or the image taken by the user is used to generate the camouflage image, which is downloaded to the device, so that the device does not need to do any camouflage generation, just display the camouflage image on its surface. The external camera could also be on the robot, which delivers and deploys a leave-behind sensor. The robot takes an image of the environment and downloads it to the leave-behind sensor, which generates a camouflage image and displays it. Or, the robot can generate the camouflage image and download it to the leave-behind sensor, which simply displays the camouflage image on its surface.

There may be one or more cameras in various embodiments. Multiple cameras onboard a robot or sensor can be used to take several images of its local environment in order to have more information about the different textures around itself. Or the mobile robot can take one image, rotate in place, take another image, and continue this process until the desired number of images is taken. Or an articulated camera on the robot or sensor can be used to take multiple images. Or an external camera held by a user is used to take multiple images.

Taking images from different areas around the object to be camouflaged provides a more comprehensive sample of the local environment. As such, the robot or sensor can then display different images on different sides of its body. This will allow it to be camouflaged better when looking at the robot or sensor from various angles.

Various methods can be used to determine the camouflage image. They are described below, and shown in FIGS. 2-9.

Figure 2:
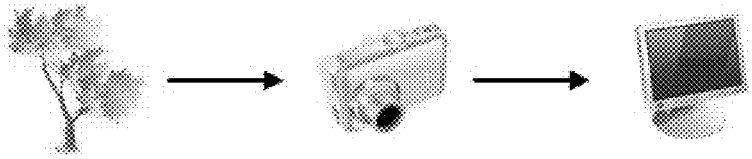
FIG. 2 shows the case of a simple display of an image taken by a camera.

FIG. 2 shows the case where there is a simple display of the image taken by the camera. In this case a camera is used to take a digital photo of the environment (as depicted in FIG. 2. The camera will have to be white balanced (FIG. 5B) so that the displayed image better matches the colors of the environment. This can be accomplished by having a sheet of white material as reference mounted on the robot or sensor. The robot first points the camera to this white reference sheet, then the robot white balances the camera, and then takes a photo of the environment. If an external camera is used then the user can white balance the camera then take an image. This photo may be sufficient to camouflage the robot.

Figure 3:
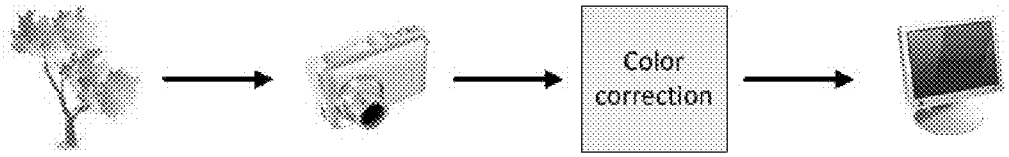
FIG. 3 shows the case where an additional color correction occurs before image display.

FIG. 3 shows the case where an additional color correction step occurs before image display. In this case in FIG. 3, the camera not only white balances but additional processing is performed on the colors to better match the environment. This additional processing may be in the form of performing image transforms based on calibration data for the camera and/or the display. The calibration data would have to be determined ahead of time and stored so that the image transform can take place on images taken by the camera.

Figure 4:
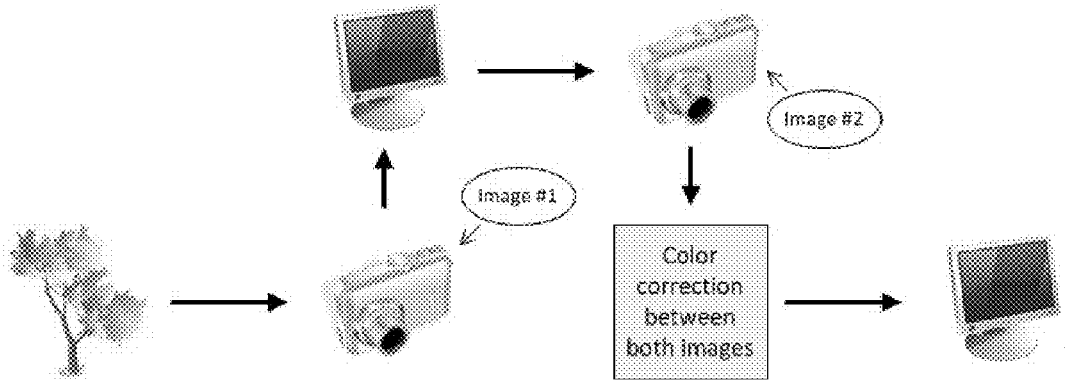
FIG. 4 shows the case of a feedback system.

FIG. 4 shows the case of a feedback system. In this case shown in FIG. 4, the camera takes two photos: one from the scene (image #1) and another from the display (image #2), which is displaying image #1. Both images are then used to color correct for the camera and the display via image transformation. The processed (color-corrected) image is then shown on the display.

Figure 5A:
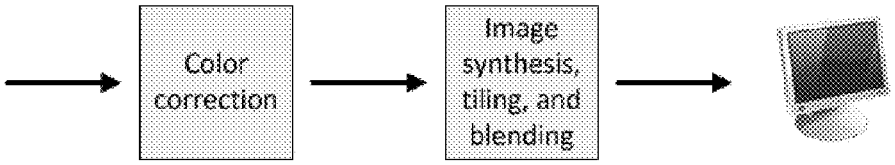
FIG. 5A shows the case of image synthesis.
Figure 5B:
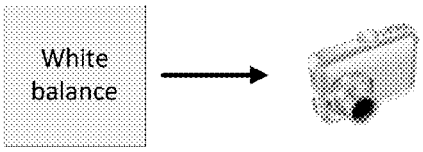
FIG. 5B shows the case of white balancing camera before samples of environment are taken.
Figure 6A:
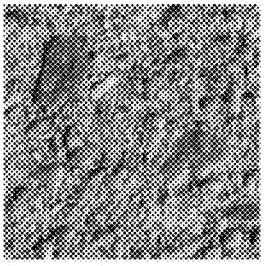
FIGS. 6-9 show views of color synthesis imaging.
Figure 6B:
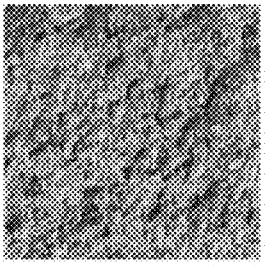
Figure 7A:
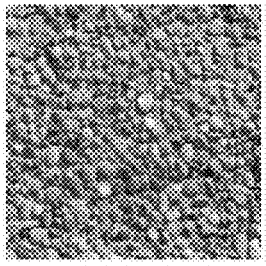
Figure 7B:
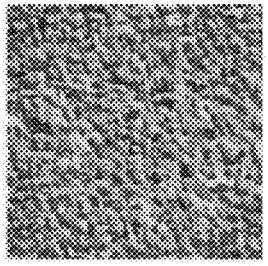
Figure 8A:
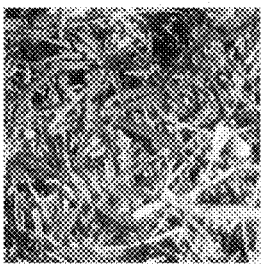
Figure 8B:
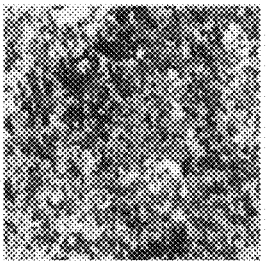
Figure 9A:
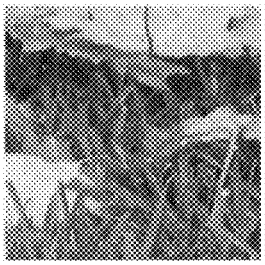
Figure 9B:
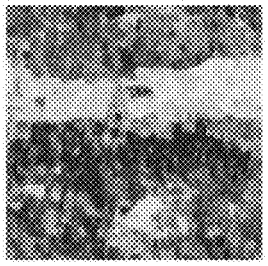

FIG. 5A shows the case of image synthesis. This case can apply to all previous cases and takes place before the image is shown on the display (and after the color correction step, if any).

In FIG. 5A, the purpose of this stage is to use the digital photo(s) taken by the camera(s) and synthesize an image that captures the characteristics of the local environment. In the prior cases, the actual digital photo taken by the camera is shown on the display and it is possible to tile those images by flipping neighboring images in order to eliminate any seams. Regarding FIG. 5A, in image synthesis, however, tiling is part of the processes and placing two or more neighboring synthesized images in a linear or grid-like manner will not produce any seam lines.

Furthermore, with image synthesize it is possible to blend images taken by the camera from different areas around the object. Image blending can be done in one of two ways: 1) Hybrid images—In this case two or more input images are used to generate a hybrid image where the hybrid image contains characteristics (colors and shapes) from all input images, or 2) Transitional images—In this case two or more images are used to generate output images that when placed next to each other transition smoothly from one synthesized image to the next. This is useful if the robot is to display different camouflage images on various sides. A smooth transition eliminates seams from one synthesized image to another and creates a transition that is more natural.

In cases which have predefined camouflage patterns, these cases can also be applied to previous cases where the robot takes an image of the environment and then renders a predefined camouflage pattern with the appropriate colors chosen based on the input image (image taken by camera). Alternatively, the robot may contain a library of camouflage patterns with colors and selects one that best matches the input image.

Image synthesis examples—there are many image synthesis algorithms available. One was chosen for this effort. Using Gray Level Co-occurrence Matrices (GLCMs) it is possible to synthesize an image from an input image. The idea is to start with a random noise image and modify this image over several iterations such that its GLCMs become statistically equivalent to the GLCMs of the input image. The GLCM algorithm is explained in a paper titled "Texture synthesis using gray-level co-occurrence models: algorithms, experimental analysis, and psychophysical support" by Anthony C. Copeland, et al. This paper describes image synthesis and hybrid image generation, all in gray scale.

For color image synthesis, however, a method was devised under this effort to allow color image synthesis that is also tileable. Examples are shown in FIGS. 6-9.

In FIGS. 6-9, the left image (FIGS. 6A, 7A, 8A, 9A) is the input image, that is, the image taken by the camera. The right image (FIGS. 6B, 7B, 8B, 9B) is the synthesized image. The synthesized image captures the essence (colors and shapes) of the input image even though it is not a perfect replica, nor should it be. Note that tiling the synthesized images in a linear or grid-like manner will not produce any noticeable seams. This is not true for the input image.

Figure 10A:
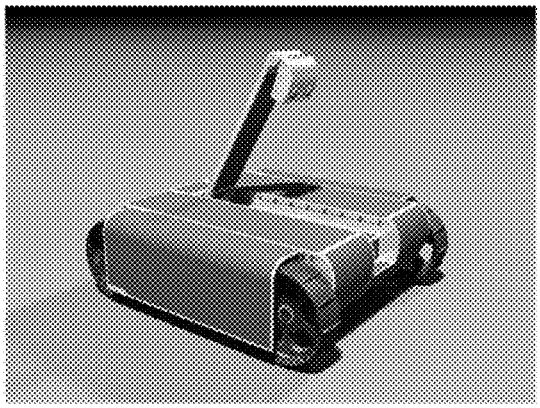
FIGS. 10A and 10B show images of a robot with AEC capability.
Figure 10B:
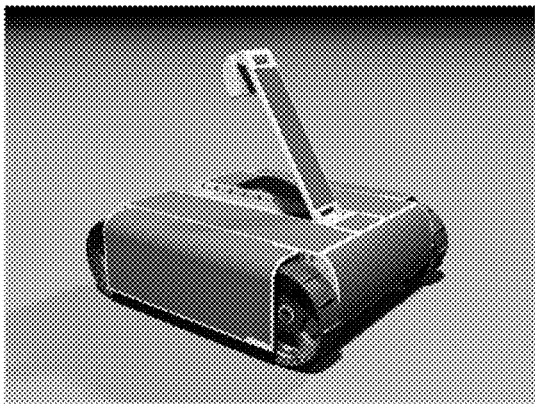

FIGS. 10A and 10B show an embodiment of the camouflaged robot concept with AEC capability. The gray panels represent the e-paper display. They are protected from the environment by a thin, transparent layer of plastic. In designing this concept, several conscious decisions were made in order to better represent some level of reality into the design. The hope is to see, in a computer generated environment, how well the AEC concept works given the limitations (i.e. the aforementioned decisions) listed below.

Notice that the panels are in FIGS. 10A and 10B are generally rectangular in shape. With the available e-paper technology today it may be possible to produce non-rectangular displays but it may be costly. Therefore, all panels shown in FIGS. 10A and 10B are generally rectangular in shape.

Notice that the panels in FIGS. 10*a* and 10B have a bezel around them. With the available e-paper technology today it may not be possible for the display pixels to come up all the way to the edge of the display. A bezel of some thickness is present to account for the address lines used by the backplane to drive the display.

Notice that the large side panels curve along the side but they bend along a single axis only. With the available e-paper technology today it is not possible to bend along more than one axis.

In FIGS. 10A and 10B, the robot arm and head are articulated to allow the robot to take a photo from its local environment from a more elevated position. Additionally, the resting bay of the robot is a good place to place a sheet of white material reference so that the robot cameras can be white balanced. Finally, the robot has stereo cameras that provide depth information. This may be a good way to perform image segmentation so the objects that are relatively far away from the robot are not taken into account as part of the input image used to synthesize the camouflage image. This also provides a good way to adjust for the size of the image displayed on the panels so that the size of what is displayed matches the size of objects around the robot from which images were taken.

FIGS. 11-16 show examples of the AEC robot in various environments and camouflaged accordingly. More particularly, FIGS. 11-12 show an arid or desert environment, FIGS. 13-14 show a grassy environment, and FIGS. 15-16 show a winter (snow) environment.

The top left view show in FIGS. 11A (arid), 13A (grassy) and 15A (winter) is the robot without AEC active. The top right view shown in FIGS. 11B (arid), 13B (grassy) and 15B (winter) is the robot with AEC active.

The bottom left views show in FIGS. 12A (arid), 14A (grassy) and 16A (winter) are the respective input images taken by the robot looking in front of itself and the bottom right views shown in FIGS. 12B (arid), 14B (grassy) and 16B (winter) are the respective synthesized images.

In the top right images shown in FIGS. 11B, 13B, and 15B, the respective synthesized image is tiled in a 4×4 configuration and projected on the displays. There are no seams when tiling because the synthesized image is tileable. Notice the effectiveness of the camouflage when looking at the right curved edge of the robot. If the display did not have a bezel, the illusion would be uninterrupted and more effective. To reduce this undesired effect the bezel can be painted a neutral color or minimized as much as possible in a real robot.

The advantages are that the AEC robot or sensor can adapt its surface colors and shapes according to the environment. This is not possible with current techniques that use fixed colors and geometric shapes painted on a surface or using camouflage nets that limit their use to specific environments. This limited use is evident by considering the fact that active military uniforms have changed numerous times to fit the latest operating environment.

Notice in particular the adaptive, changeable camouflage patterns displayed by the vehicle shown in FIG. 11B for an arid environment, then changed to a grassy pattern in a grassy environment shown in FIG. 13B, and finally changed to a winter camouflage pattern in the winter environment shown in FIG. 15B.

Additional advantages that revolve around using e-paper are that there is no power consumption for image display. This allows camouflaging for ISR robots or sensors for extended periods of time. It is flexible enough to fit around corners making it possible to retrofit an existing robotic platform or sensor with this capability. The e-paper requires no backlight as it reflects ambient light like paper. This eliminates the need to adjust the backlight under changing ambient lighting conditions.

Camouflaging need not be limited to situations where the robot is static. With improved display technology it may possible to continuously change the camouflage while a robot is on the move. For example, the robot can be moving in one direction while a continuous camouflaging pattern moves across its surface in the opposite direction relative to the robot.

Currently e-paper is the only viable solution for long-term ISR operations where power consumption is critical. It is possible to use LCDs or organic LED (OLED) displays as well, which have superior color characteristics when compared to color e-papers. LCDs are not flexible but OLEDs displays can be. For short-term camouflaging where power consumption is not an issue, LCD or OLED displays may be practical. As technology improves other display sources may be used that fit the required characteristics. It may be possible, for example, to embed the display technology with the outer covering material of a robot or sensor, providing a hybrid display/shell solution. Or, other materials may be developed that can change their colors and shapes. Whatever the display technology may be, what is of utmost importance is determining what to display.

Figure 17:
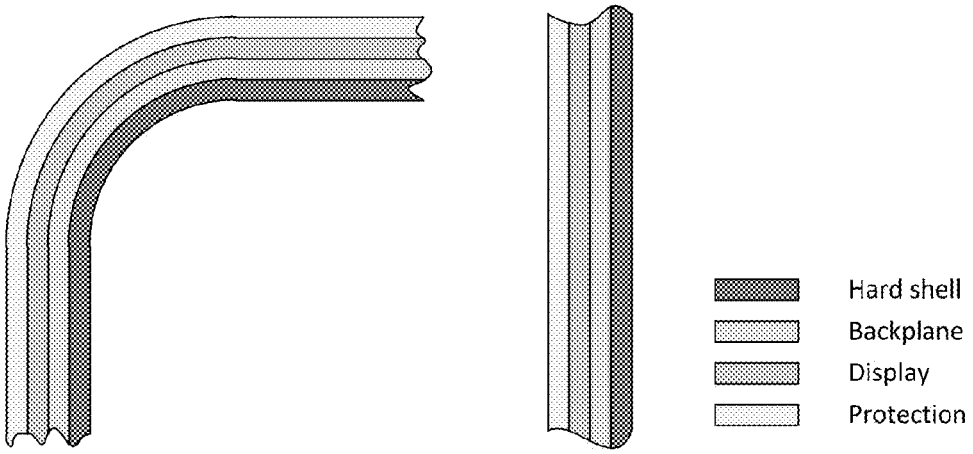
FIG. 17 illustrates an embedded display concept showing curved and straight surfaces.

FIG. 17 illustrates the embedded display concept with curved and straight surfaces. FIG. 17 is of a cross section of a curved surface, similar to the curved edges of the robot in the computer generated scenes. Curvature is not required, but is preferable to have. The shell layer is the hard protective material from which the enclosure that houses the electronics of the robot or sensor is built. It can be made of aluminum, hard plastic, etc., for example. Over this shell lies the backplane for the display. The backplane drives the display. Some flexible displays like those made from Organic Light Emitting Diodes (OLEDs) do not require a backplane so this layer may be omitted. Backplanes are planar but curved backplanes exist and continue to be developed. Arizona State University, for example, has developed curved backplanes. The flexible display (e.g. e-paper) lies over the backplane. To keep it from exposure to the environment a protective transparent layer of plastic covers the display. This protection layer keeps the display safe from the elements and damage by rocks, branches, etc.

Additional uses for the present invention may be platforms for commercial products. Suppose a kitchen countertop is developed that has panels of e-paper embedded inside with a protective transparent material over the panels. The colors and patterns may then be changed by the user, which would provide a new look for the kitchen. Or suppose the kitchen floor tiles have embedded e-paper. The user simply changes the colors and/or patterns to obtain a new look for the floor. As the user gets tired of the same look, he or she can change the color and/or patterns again without the need of expensive and messy remodeling. And because such displays only consume power when changing the image there is no cost in having to maintain the image. Furthermore, individual tiles, if damaged, can be simply removed and replaced. This can also be true for robots and leave-behind sensors. If a display is damaged it can be removed and replaced with a new one.

From the above description, it is apparent that various techniques may be used for implementing the concepts of the present invention without departing from its scope. The described embodiments are to be considered in all respects as illustrative and not restrictive. It should also be understood that the present invention is not limited to the particular embodiments described herein, but is capable of many embodiments without departing from the scope of the claims.

What is claimed is:

1. An adaptive electronic camouflage platform comprising:

electronic paper panels conformed to the exterior surface of the platform which moves through a changing local environment;

one or more cameras for sampling multiple changing images of the changing local environment surrounding the platform;

a processor for analyzing the sampled images, generating changing synthesized camouflage patterns including shapes, brightness levels and color differences corresponding to the respective changing sampled images and controlling the display of the synthesized camouflage patterns on the electronic paper panels, including displaying changeable camouflage patterns corresponding to changes in the surrounding environment when the platform moves through changing surrounding environments such that the displayed camouflage patterns generally shroud the outer surface of the platform and roughly match the changing local environment, including shapes, brightness levels and color differences, when viewed by one or more human observers, wherein the processor controls the display of the changeable camouflage patterns which are tileable corresponding to changes in the surrounding environments when the platform moves through the changing surrounding environments where tiling includes placing two or more neighboring synthesized images in a grid-like manner which are representative of the sampled images yet does not produce any seam lines and where the sampled images are blended and the blending includes generating hybrid images using two or more of the sampled images as input such that the hybrid image contains characteristics including colors and shapes from all the input images or generating transitional images where two or more of the sampled images used to generate output images that when placed next to each other transition smoothly from one output image to the next;

wherein the one or more cameras are articulated cameras for taking the sampled images of surrounding views from elevated positions; and wherein the articulated cameras are stereo cameras for providing depth information to aid performing image segmentation so that the objects that are relatively far away from the platform are not taken into account in synthesizing the camouflage patterns.

2. The platform of claim 1 wherein some of the electronic paper panels are rectangular in configuration to conform to generally flat surfaces of the platform.

3. The platform of claim 2 wherein some of the electronic paper panels have curved portions to conform to curved surfaces of the platform.

4. The platform of claim 3 wherein the processor provides color correction of the sampled images.

5. The platform of claim 4 wherein the processor provides color correction between multiple sampled images.

6. An adaptive electronic camouflage vehicle comprising:

flexible electronic displays forming the exterior surface of the vehicle which moves through a changing local environment;

one or more cameras embedded within the vehicle for sampling multiple changing images of the changing local environment surrounding the vehicle;

a processor for analyzing the sampled images, generating synthesized camouflage patterns including shapes, brightness levels and color differences corresponding to the respective changing sampled images and controlling the display of the synthesized camouflage patterns on the flexible electronic displays, including displaying changeable camouflage patterns corresponding to changes in the surrounding environment when the vehicle moves through changing surrounding environments such that the displayed camouflage patterns generally shroud the outer surface of the vehicle and roughly match the changing local environment, including shapes, brightness levels and color differences, when viewed by one or more human observers;

wherein the processor controls the display of the changeable camouflage patterns which are tileable corresponding to changes in the surrounding environments when the vehicle moves through the changing surrounding environments where tiling includes placing two or more neighboring synthesized images in a grid-like manner which are representative of the sampled images yet does not produce any seam lines and where the sampled images are blended and the blending includes generating hybrid images using two or more of the sampled images as input such that the hybrid image contains characteristics including colors and shapes from all the input images or generating transitional images where two or more of the sampled images used to generate output images that when placed next to each other transition smoothly from one output image to the next;

wherein the one or more cameras are articulated cameras for taking the sampled images of surrounding views from elevated positions; and wherein the articulated cameras are stereo cameras for providing depth information to aid performing image segmentation so that the objects that are relatively far away from the vehicle are not taken into account in synthesizing the camouflage patterns.

7. The vehicle of claim 6 further including a resting bay containing white sheets so that the one or more cameras are white balanced.

* * * * *